US007878620B2

(12) United States Patent
Hasegawa

(10) Patent No.: US 7,878,620 B2
(45) Date of Patent: Feb. 1, 2011

(54) LIQUID-DROPLET EJECTING APPARATUS

(75) Inventor: Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 105 days.

(21) Appl. No.: 12/371,537

(22) Filed: Feb. 13, 2009

(65) Prior Publication Data

US 2009/0201334 A1 Aug. 13, 2009

(30) Foreign Application Priority Data

Feb. 13, 2008 (JP) ..... 2008-032214

(51) Int. Cl.
*B41J 2/165* (2006.01)

(52) U.S. Cl. ..... 347/29; 347/30; 347/32

(58) Field of Classification Search ..... 347/24, 347/28, 29, 30, 32, 33, 23
See application file for complete search history.

(56) References Cited

U.S. PATENT DOCUMENTS 5,534,898 A * 7/1996 Kashino et al. ..... 347/33
5,877,788 A * 3/1999 Haan et al. ..... 347/28
6,206,499 B1 * 3/2001 Iijima et al. ..... 347/33
7,735,966 B2 * 6/2010 Silverbrook ..... 347/47

FOREIGN PATENT DOCUMENTS

JP H04-176657 A 6/1992
JP H10-202908 A 8/1998

* cited by examiner

*Primary Examiner*—Shih-wen Hsieh
(74) *Attorney, Agent, or Firm*—Baker Botts L.L.P.

(57) ABSTRACT

A liquid-droplet ejecting apparatus has a drawing mechanism and an ejection head. The ejection head has a nozzle face and a protection plate. The protection plate has a frame portion and a first end positioned at a first widthwise plane, and a second end positioned at a second widthwise plane. The protection plate has a first and a second opening formed therethrough. The first opening is in fluid communication with the nozzles, and the second opening provides fluid communication with the nozzles and an exterior of the ejection head. A cap member selectively contacts the nozzle face and the protection plate, and the drawing mechanism operates in a first mode in which the cap member covers the first and the second opening, and a second mode in which the cap member covers only one of the first and the second opening.

18 Claims, 14 Drawing Sheets

LIQUID-DROPLET EJECTING APPARATUS

CROSS-REFERENCE TO RELATED APPLICATIONS

The present application claims priority to and the benefit of Japanese Patent Application No. 2008-032214, which was filed on Feb. 13, 2008, the disclosure of which is incorporated herein by reference in its entirety.

BACKGROUND OF THE INVENTION

1. Field of the Invention

The present invention relates to liquid-droplet ejecting apparatuses for ejecting liquid from nozzles and in particular, it relates to a liquid-droplet ejecting apparatus having a drawing mechanism for forcedly drawing liquid from the nozzles.

2. Description of the Related Art

In an inkjet recording apparatus, e.g., a liquid droplet ejecting apparatus, while an ejection head is displaced relative to a recording medium, e.g. a sheet as an ejection target object, ink is ejected from the ejection head. If the recording medium is transferred in a curved state, and if deformation or waviness is produced in the recording medium, the recording medium may contact with a nozzle face or a nozzle opening end, thereby damaging it.

In a known inkjet head, e.g., the inkjet head set forth in Japanese Unexamined Patent Application Publication No. H04-176657, the nozzle face is provided with a recess and a nozzle is formed within the recess. That is, if the nozzle face is damaged, ink may be remained in a damaged portion to come in contact with the ink just started from the nozzle for deflecting the ejection direction. Also, when the nozzle opening end is damaged, an ink meniscus is not normally formed in the nozzle, causing ejection failure. Therefore, by providing the recess in the vicinity of the nozzle, the nozzle is protected from coming into contact with the recording medium.

However, the depth of the recess to be formed on the nozzle face is shallow, so that the nozzle cannot be sufficiently avoided from coming into contact with the recording medium. In the known inkjet head, a foreign material, e.g. dust and rubbish, may creep within the opening, so that the ink ejection direction may be deflected. Also, ink may remain in a corner portion of the opening defined by the nozzle face, and the ink may drop on the recording medium to stain the medium therewith, even when used with a wiper.

SUMMARY OF THE INVENTION

The present invention has been made in order to solve the problems described above, and it is an object of the invention to achieve a liquid ejection apparatus capable of satisfactorily removing residual ink in an ejection head as well as improving a function to protect nozzles.

In an embodiment of the invention, a liquid-droplet ejecting apparatus comprises a drawing mechanism configured to draw liquid from a plurality of nozzles, and an ejection head. The ejection head comprises a nozzle face comprising the plurality of nozzles, wherein the plurality of nozzles are configured to eject liquid and a protection plate configured to protect the plurality of nozzles. The protection plate comprises a frame portion surrounding the plurality of nozzles, a first end fixed to the nozzle face and positioned at a first widthwise plane, and a second end opposite the first end, wherein the protection plate has a first opening and at least one second opening formed therethrough, wherein the first opening is configured to provide fluid communication between at least one of the plurality of nozzles and an exterior of the ejection head, and wherein the at least one second opening is configured to provide fluid communication between the plurality of nozzles and an exterior of the protection plate at a second widthwise plane, wherein at least a portion of the protection plate and at least a portion of the nozzle face define at least one flow path therebetween, and the at least one flow path is configured to provide fluid communication between the first opening and the at least one second opening. The drawing mechanism comprises a cap member configured to selectively contact and separate from at least one of the nozzle face of the ejection head and the protection plate, wherein when the cap member contacts the at least one of the nozzle face and the ejection head, a space is formed between the cap member and the at least one of the nozzle face and the ejection head, and a pressure reducing member configured to reduce the pressure in the space, wherein the drawing mechanism is configured to selectively operate in one of a first mode in which the cap member covers the first opening and the at least one second opening, and the drawing mechanism draws ink from the first opening and from the at least one second opening, and a second mode in which the cap member seals one of the first opening and the at least one second opening, and the drawing mechanism draws ink from the sealed one of the first opening and the at least one second opening.

BRIEF DESCRIPTION OF THE DRAWINGS

For a more complete understanding of the invention, reference now is made to the following descriptions taken in connection with the accompanying drawings.

DETAILED DESCRIPTION OF EMBODIMENTS

Exemplary embodiments of the present invention may be understood by referring to FIGS. 1-14, like numerals being used for like corresponding parts in the various drawings.

Figure 1:
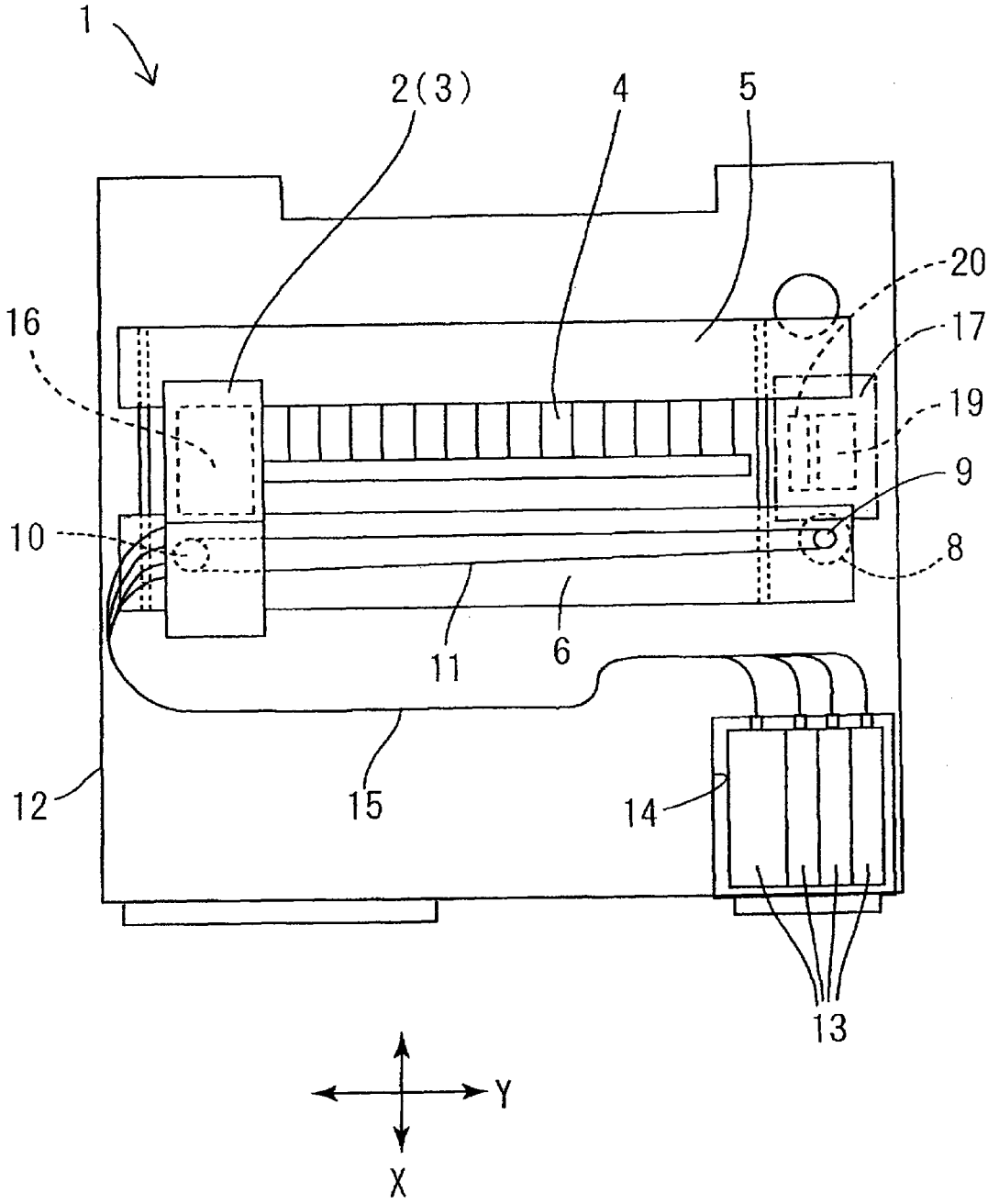
FIG. 1 is a schematic plan view of a recording apparatus as a liquid-droplet ejection apparatus according to an embodiment of the invention.

FIG. 1 is a schematic plan view of a liquid-droplet ejection apparatus, e.g., recording apparatus 1, according to an embodiment of the invention. The recording apparatus 1 may be incorporated in a single printer or in a printer function, e.g., a recording section of a multifunctional system having a plurality of functions, e.g., a facsimile system and a copying machine.

Figure 4:
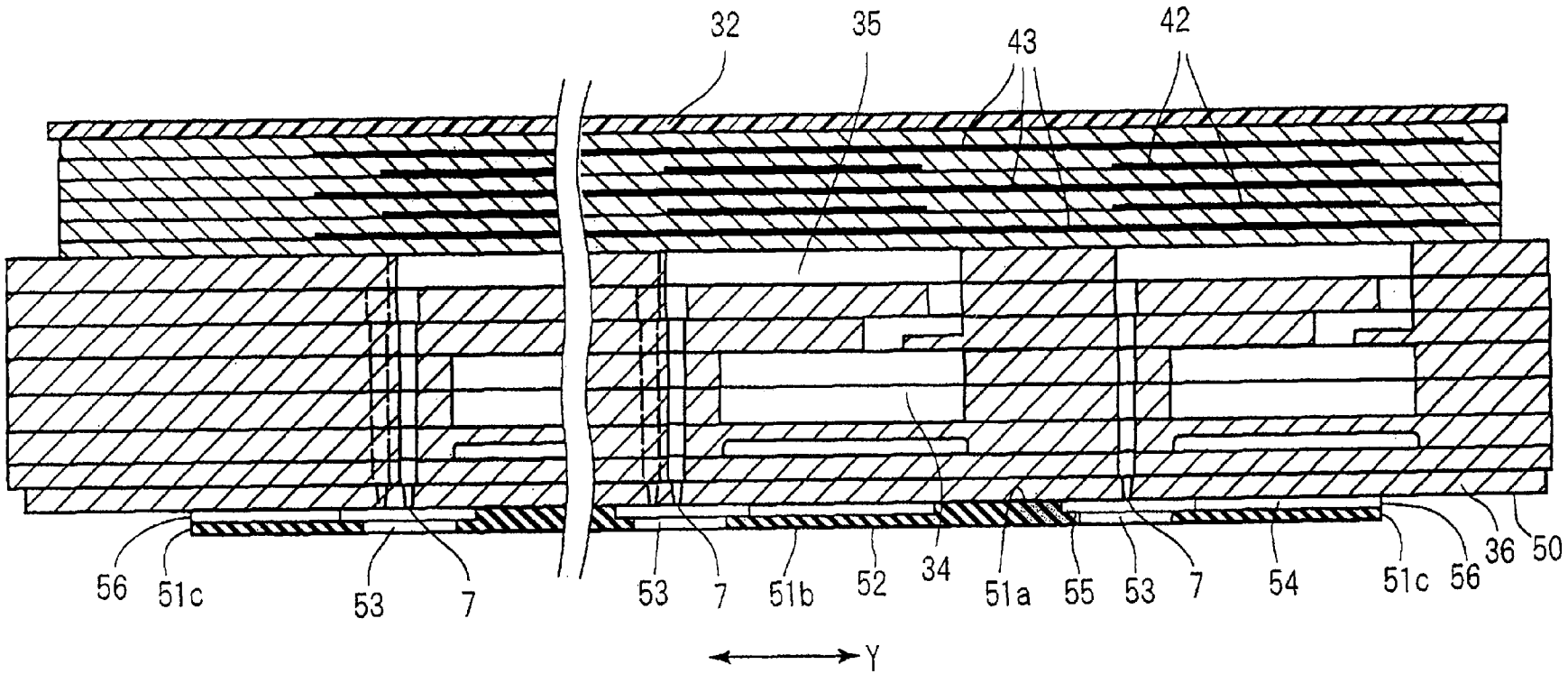
FIG. 4 is a longitudinal sectional view of the recording head taken in Y-axis direction, according to an embodiment of the invention.

As shown in FIG. 1, recording apparatus 1 may comprise a recording head 3 mounted on a carriage 2, e.g., as an ejection head, and a platen 4 disposed to oppose the bottom surface of the recording head 3. Referring to FIG. 4, nozzles 7 within recording head 3 may be exposed toward a recording sheet on the platen 4. Referring again to FIG. 1, the carriage 2 movably may be supported along a first guide member 5 and a second guide member 6 in parallel (Y-axis direction) with the recording sheet on the platen 4, e.g., in the Y-axis direction, such that the recording sheet may be scanned with the carriage 2. A carriage motor 8 may drive carriage via a timing belt 11 stretched between a follower pulley 10 and a driving pulley 9 attached to carriage motor 8. In an embodiment as described herein, the side adjacent to the nozzle face of the recording head 3 denotes the lower side and the opposite side represents the upper side.

The recording sheet may be conveyed as an ejection target object along a sub-scanning direction, e.g., the X-axis direction, which may be perpendicular to the main scanning direction, e.g., the Y-axis direction of the carriage 2. The recording head 3 may eject ink from the nozzles 7 to print images on the recording sheet. In addition, one of the recording head 3 and the recording sheet may move relative to the other in Y-axis direction and X-axis direction.

As shown in FIG. 1, a storage space 14 may be provided within a body frame 12, for replaceable ink cartridges 13. The number of the ink cartridges 13 may correspond to the number of colors accommodated. In an embodiment, four cartridges, e.g., for black, cyan, magenta, and yellow ink, may be provided. Ink in each cartridge 13 may be independently supplied to the recording head 3 on the carriage 2 via a flexible ink-supply tube 15, e.g., a resin tube.

As shown in FIG. 1, an ink receiver 16 may be disposed on one side, e.g., on the left side of the body frame 12 of the recording apparatus 1. A maintenance unit 17 may be disposed on the other side, e.g., on the right side as shown in FIG. 1. Ink may be periodically ejected from the recording head 3 before recording, during recording, or both, which may prevent the nozzle from clogging at a position opposite to the ink receiver 16.

Recording head 3 may be cleaned by a maintenance unit 17, in an operation which will be described in detail herein. The cleaning operation may comprise a drawing purge operation for drawing failure ink, e.g. viscous ink, from the nozzles 7 and also may comprise a wiping operation of sweeping ink adhered on a nozzle face 50 after the drawing purge operation.

Figure 3:
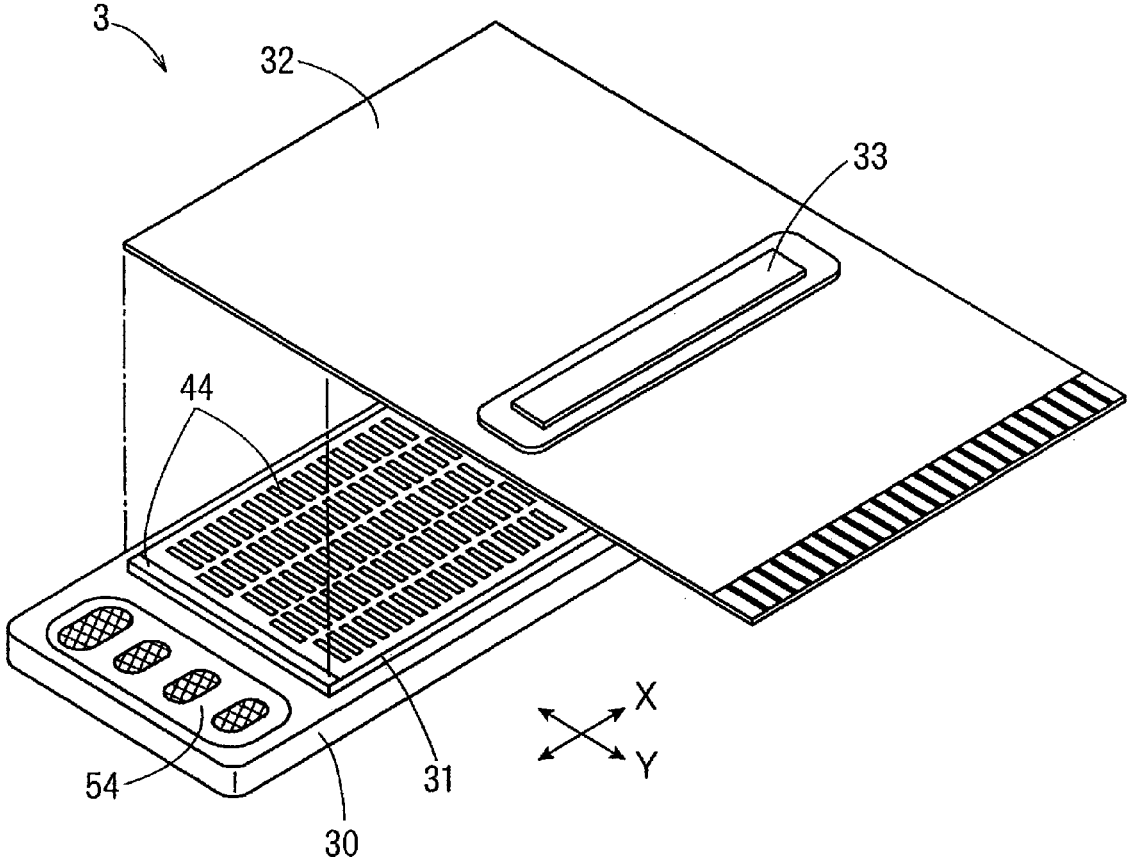
FIG. 3 is a perspective view of a recording head according to an embodiment of the invention.
Figure 5:
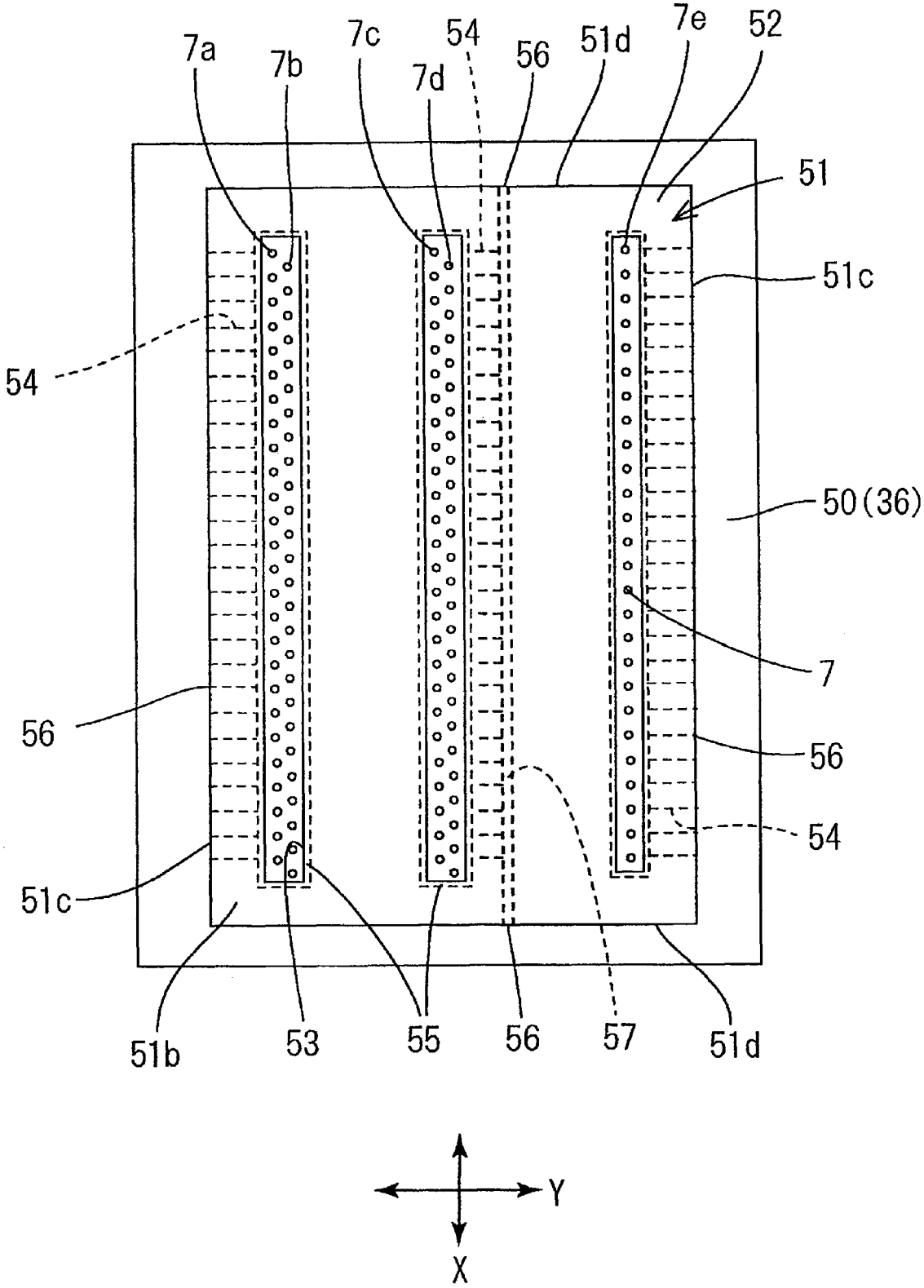
FIG. 5 is a bottom view of the recording head according to an embodiment of the invention.
Figure 6:
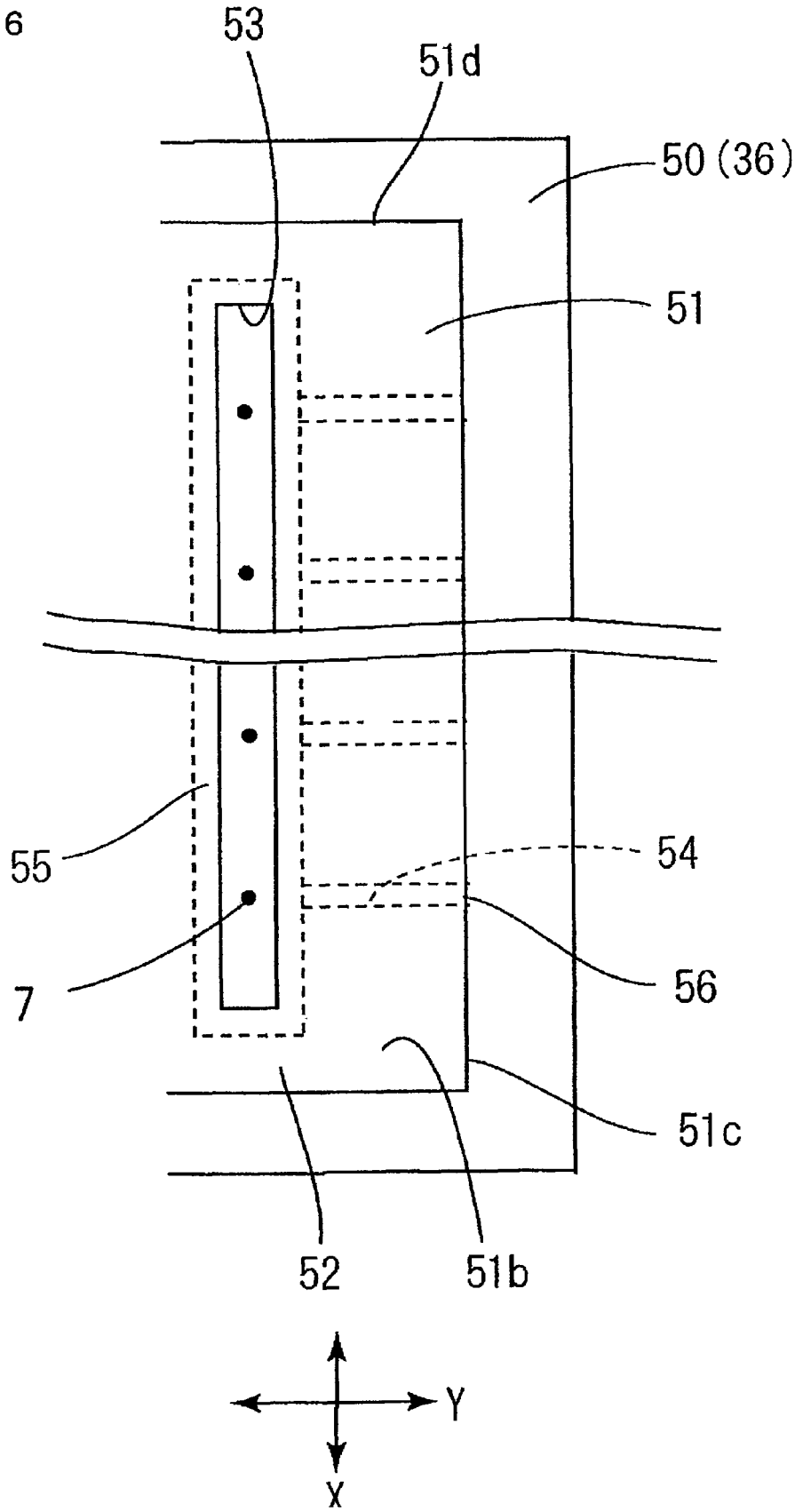
FIG. 6 is an enlarged view of an essential portion of the bottom surface of the recording head according to an embodiment of the invention.
Figure 7:
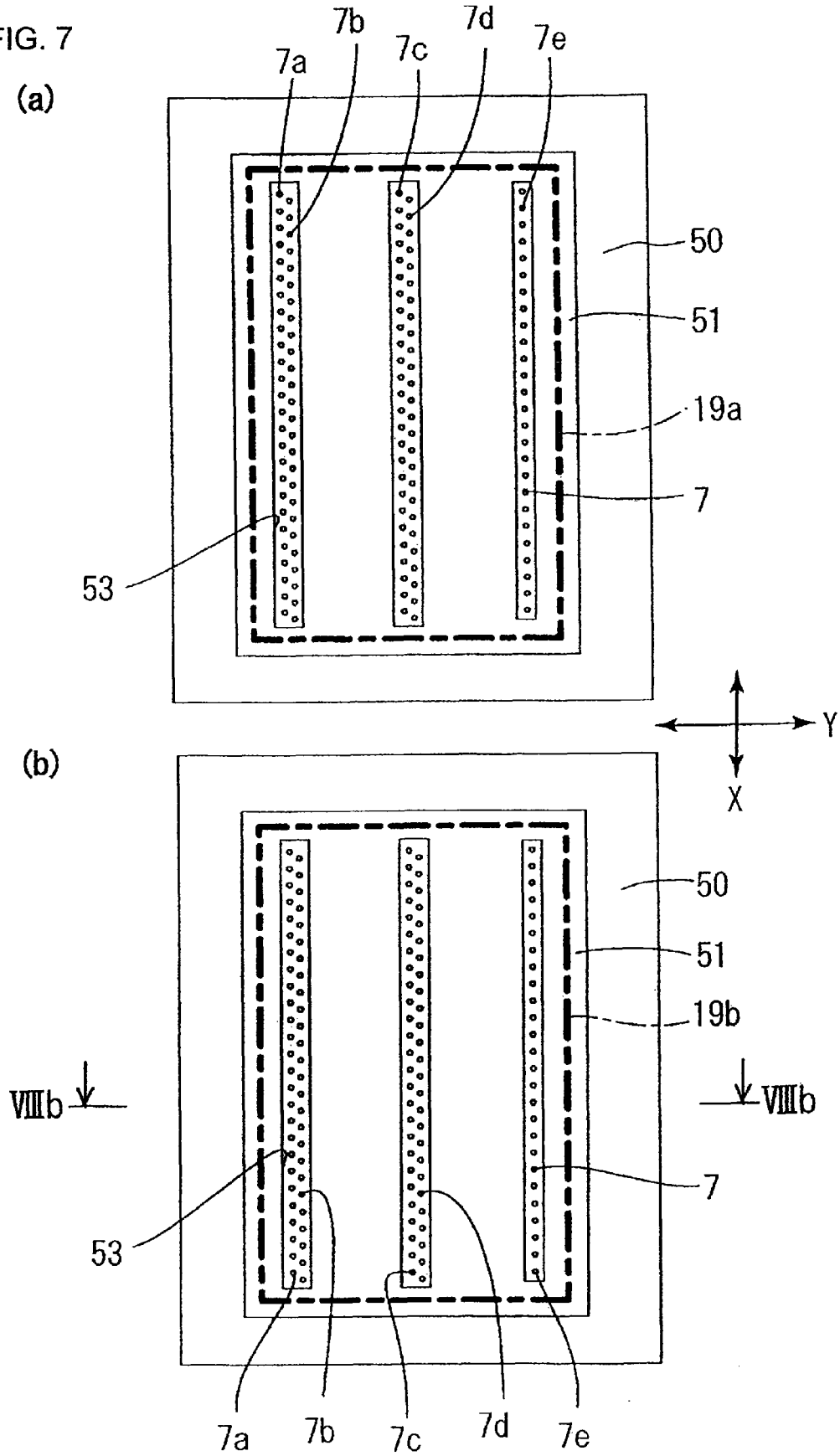
FIG. 7A is a bottom view illustrating the relationship between the recording head and a large cap body according to an embodiment of the invention.
FIG. 7B is a bottom view illustrating the relationship between the recording head and a small cap body according to an embodiment of the invention.

As shown in FIGS. 3 and 4, recording head 3 may comprise the nozzles 7 opened on the lower plane, e.g., on the nozzle face 50, a cavity unit 30 arranged adjacent to the upper plane and having pressure chambers 35 corresponding to the respective nozzles 7, actuators 31 for pressurizing the pressure chambers 35, respectively, and flexible wiring members 32 which may output drive signals to the actuators 31, which may be stacked. As shown in FIG. 5, a number of the nozzles 7 may be arranged in an X-axis direction, e.g., in a line for each color. The five lines also may be arranged in Y-direction at specific intervals. Reference numerals 7*a* to 7*e* refer to the individual lines of the nozzles 7, respectively. In an embodiment, the five lines may be arranged at equal intervals, e.g., the distance between the five lines may be equal. In another embodiment, two lines may be disposed closer to each other, such that the nozzles 7 may be aligned in a staggered arrangement.

Referring to FIG. 5, from the left, numerals 7*a* and 7*b* may correspond to nozzle lines for black ink, and numerals 7*c* to 7*e* may correspond to nozzle lines for cyan ink, magenta ink, and yellow ink, respectively. The pressure chambers 35 also may be provided such that pressure chambers 35 correspond to the nozzles 7, and pressure chambers 35 also may be disposed in five lines in the Y-direction at specific intervals.

Referring to FIG. 4, the cavity unit 30 may be configured by stacking a plurality of thin plates to form a series of ink supply paths within. In the ink supply path, ink may be introduced into the cavity unit 30 from the cartridge 13. The introduced ink may be allocated into a number of the pressure chambers 35 via manifold chambers 34 provided for each line of the pressure chambers 35, and the ink then may be supplied to the nozzles 7.

Each of the plates which together comprise the cavity unit 30 may have a thickness of about 40 to 150 μm. A nozzle plate 36, on which the nozzles 7 may be formed, may comprise synthetic resin with a thickness of about 70 μm. The resin may use a polyimide resin in view of its ink resistance properties and its excellence in machinability during laser-processing of the nozzles 7. The other plates are made of an alloy, e.g., a 42%-nickel alloy steel, and may have holes and recesses formed therethrough and therein, to construct the ink flow path. The lower plane of the nozzle plate 36, e.g., the nozzle face 50, may comprise a material having repellency against ink to be ejected. In another embodiment, nozzle face 50 may be processed to have a property of repelling ink.

As shown in FIGS. 4 to 8, a protection plate 51 may be fixed on the nozzle face 50, and may protect the nozzles 7. The protection plate 51 may be a metallic plate-like member having an external surface smaller in plan area than the nozzle face 50. Thus, a surface of the protection plate 51, e.g., the upper surface, may be smaller than the surface of nozzle face 50 to which the protection plate 51 may be attached. In the protection plate 51, the upper surface opposing the nozzle face 50, may lie in a widthwise plane at which plane nozzle face 50 and protection plate 51 may be joined, e.g., at a first widthwise plane 51*a*. Second widthwise plane 51*b* may be a plane on an opposite side of the protection plate 51 from first widthwise plane 51*a*, parallel to first widthwise plane 51*a*, and opposing the recording medium. As shown in FIGS. 4 and 5, sides 51*c* may be perpendicular to the first and second widthwise planes 51*a* and 51*b* and may lie in the Y-axis direction, e.g., and extend in the X-axis direction. Sides 51*d* may be perpendicular to the first and second widthwise planes 51*a* and 51*b*, and may lie in the X-axis direction, e.g., and extend in the Y-axis direction.

Protection plate 51 may comprise sides 51*c* and 51*d*, on which open portions, e.g., first openings 56 may be formed, respectively. The protection plate 51 may comprise a frame portion 52 which may substantially surround the nozzles 7. Moreover, the frame portion 52 may have at least an opening, e.g., a through portion, e.g., a second opening 53 formed therethrough, in the plate thickness direction. Second opening 53 may expose the nozzles 7 to an exterior of the protection plate 51 at the second widthwise plane 51*b*. The second openings 53 may be formed at positions opposing the nozzle lines 7*a* and 7*b*, the nozzle lines 7*c* and 7*d*, and the nozzle line 7*e*, respectively, and each second opening 53 may be formed in a continuous elongated shape in the extending direction of the nozzle lines, e.g., in the X-axis direction.

As shown in FIG. 5, in an embodiment in which the nozzle lines 7*a* and 7*b*, are disposed close to each other, and the nozzle lines 7*c* and 7*d* also are disposed close to each other, one second opening 53 may be disposed to commonly oppose the respective lines, and for the residual one nozzle line 7*e*, a single second opening 53 may oppose the line. In an embodiment in which the respective five lines are arranged at intervals, the second openings 53 may be arranged to oppose the respective five lines.

Figure 8:
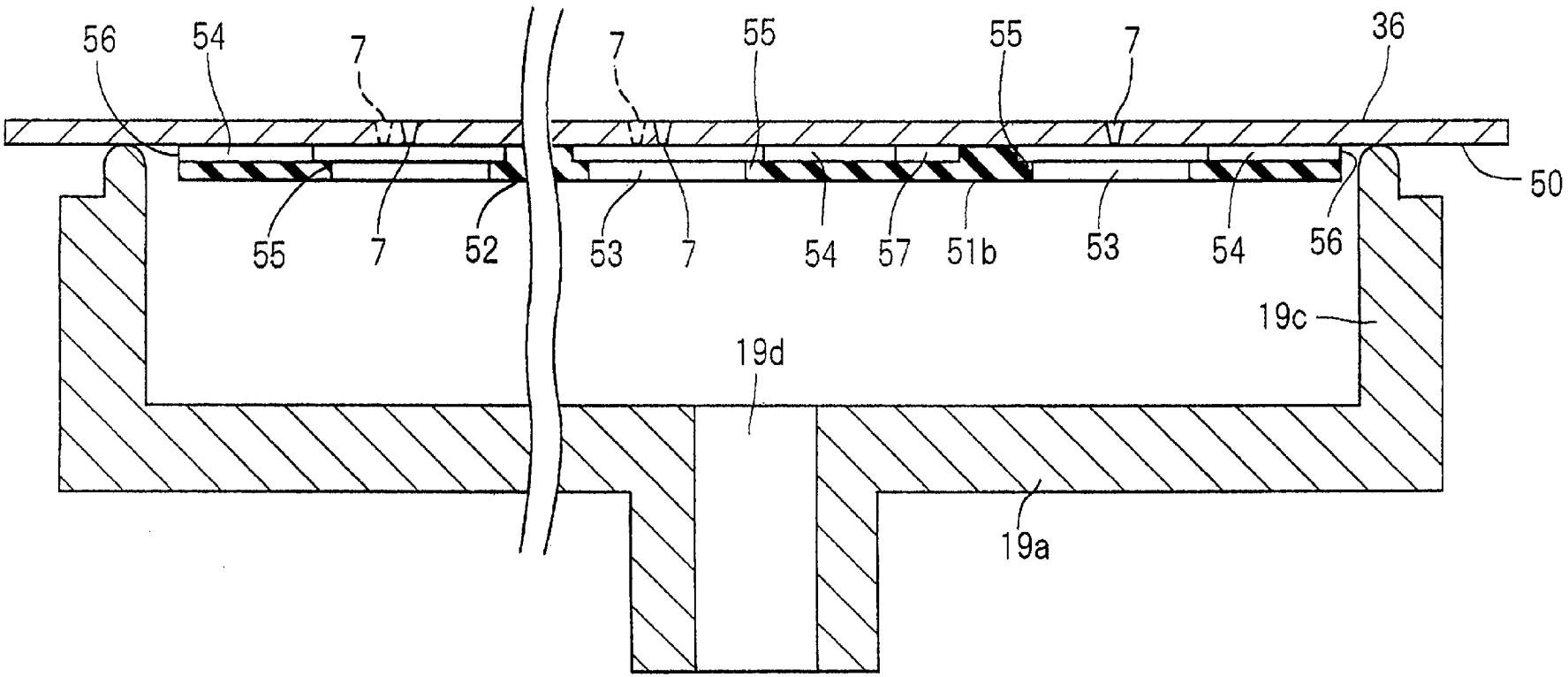
FIG. 8 is a sectional view of the recording head and the large cap body shown in FIG. 7A.

Referring to FIGS. 3 and 8, at the end of each second opening 53, adjacent to the second widthwise plane 51*b*, a hood portion 55 may be disposed to extend within the second opening 53, such that the exposed portion of second opening 53 may be reduced in diameter. Hood portion 53 may have a lower thickness, e.g., may be thinner, than that of the protection plate 51. Hood portion 55 may be disposed at the second opening 53, which may enable ink to remain between the nozzle face 50 and the upper surface of the hood portion 55. In another embodiment of the invention, the hood portion 55 may be omitted.

The length of the second opening 53 in the X-axis direction may be longer than that a length of the nozzle line in the X-axis direction, and the length of the second opening 53 may be longer or shorter than the length of a sweeping member 20, also in the same direction, e.g., the X-axis direction. The width of the second opening 53 in Y-axis direction and the thickness of the protection plate 51 may be established such that the sweeping member 20 may sweep the nozzle face 50 in the vicinity of the vicinity of each nozzle 7 by scanning the recording head 3 in the Y-axis direction with the sweeping member 20. Specifically, the width of the second opening 53 and the thickness of the protection plate 51 may be established such that during scanning, when the sweeping member 20 comes in contact with the protection plate 51, the end of the sweeping member 20 may enter the second opening 53 due to the elasticity of the sweeping member 20 and the deformation of the sweeping member 20 when the sweeping member comes into contact with the nozzle face 50 and the protection plate 51.

In another embodiment of the invention, the width of the second opening 53 may be relatively narrower than in the above embodiment, and the thickness of the protection plate 51 may be relatively larger than in the above embodiment. Nevertheless, in this embodiment, the width of the second opening 53 and the thickness of the protection plate 51 may be established by controlling the balance of the sweeping with the sweeping member 20. In this embodiment, the width of the second opening 53 may be about 500 μm to 2 mm, and the thickness of the protection plate 51 may be about 100 μm to 200 μm.

A flow path, e.g., a groove portion 54 may be formed on the first widthwise plane 51*a* of the protection plate 51. Groove portion 54 may be concavely grooved, and may extend in a direction separating from the second opening 53. A first end of the groove portion 54 may be in fluid communication with the second opening 53, e.g., the portion other than the hood portion 55, such that when the protection plate 51 is fixed on the nozzle face 50, a path, e.g., a flow path may be formed with the groove portion 54. On the sides 51*c* and 51*d*, first openings 56 may be formed, respectively. Each first opening 56 may be configured to be in fluid communication with the other end of the groove portion 54, and may be configured to open outside, e.g., to also be in fluid communication with an exterior of the recording head 3. Namely, the second opening 53 may be configured to be in fluid communication with the outside, e.g., an exterior of the protection plate 51, via the groove portion 54 and the first opening 56.

In an embodiment of the invention, the groove portions 54 may be in fluid communication with the two second openings 53 which may be positioned on each end of protection plate 51 in the Y-direction, respectively. These groove portions 54 linearly may extend toward the sides 51*c* on both ends in the Y-direction, respectively, to open to the outside, e.g., to an exterior of the recording head 3. Other groove portions 54, which may be in fluid communication with the central second opening 53, may extend toward the sides 51*d* on both ends in the X-axis direction, via auxiliary flow paths, e.g., groove portions 57. Auxiliary groove portions 57 may extend substantially in parallel with the second openings 53, respectively. The auxiliary groove portions 57 may be concavely formed on the first widthwise plane 51*a* of the protection plate 51, and may connect to the groove portion 54. Both ends of the auxiliary groove portion 57 may be opened to the outside, e.g., may be in fluid communication with an exterior of recording head 3, at the sides 51*d*, as first openings 56, respectively.

In another embodiment of the invention, the arrangement pattern of the groove portions 54 may be appropriately changed, such that if the number of the second openings 53 is two or less and the space between the nozzle lines is relatively large, the auxiliary groove portion 57 may be omitted. In this embodiment, the groove portions 54 also may be extended toward the respective sides 51*d*, from both ends of the second opening 53 in the X-axis direction. When the groove portion 54 is preferably small in width, such that ink may be brought in by capillary action and the pitch is the same as or smaller than that of the nozzle in the line direction, the ink trapped inside the second opening 53 easily may be retrieved, e.g., pulled in, e.g., by the drawing mechanism.

Water-repellent finishing may be processed on the surface of protection plate 51 at second widthwise plane 51*b*, opposing the recording sheet, in the same way as in the nozzle face 50. Moreover, inkphilic, e.g., hydrophilic, processing also may be performed for increasing the contacting force of the protection plate 51 applied to the ink at the second widthwise plane 51*b*, relative to the nozzle face 50. By the inkphilic processing, the ink stuck to the protection plate 51 at the second widthwise plane 51*b* may wetly expand. This expansion may increase the difficulty of dropping the ink on the recording sheet as ink droplets. Thus, to reduce the difficulty of dropping the ink on the recording sheet as ink droplets, the inkphilic process may include increasing the surface roughness of protection plate 51 at a surface that lies within second widthwise plane 51*b*, by plasma treatment, or by forming a number of fine dimples or grooves, in addition to the known thin-film deposition.

Referring to FIG. 4, the actuator 31 may employ various systems, e.g., a piezoelectric system, an electrothermal conversion system, and a diaphragm vibration system with static electricity. As shown in FIG. 4, in an embodiment of the invention, the actuator 31 may employ the piezoelectric system in that a plurality of flat piezoelectric ceramic layers 41, e.g., PZT layers, with a size sufficient to cover all the pressure chambers 35, may be deposited, and electrodes 42 and 43 may be disposed therebetween. The electrodes may comprise an individual electrode 42 provided for each pressure chamber 35 and a common electrode 43 common to a plurality of the pressure chambers 35. By applying voltage on the electrodes, the piezoelectric ceramic layer 41 between both the electrodes may be displaced, such that ink may be ejected from the nozzle 7, by applying the pressure to the ink contained in the pressure chamber 35.

As shown in FIG. 3, the individual electrode 42 and the common electrode 43 may be electrically connected to an external electrode 44. External electrode 44 may be formed on the top plane of the actuator 31 via a through hole, and the external electrode 44 may be electrically connected to an electrode pattern of the flexible wiring member 32. Thereby, a drive signal from an external signal source may be inputted in the actuator 31 via a circuit element 33 mounted on the flexible wiring member 32.

Figure 2:
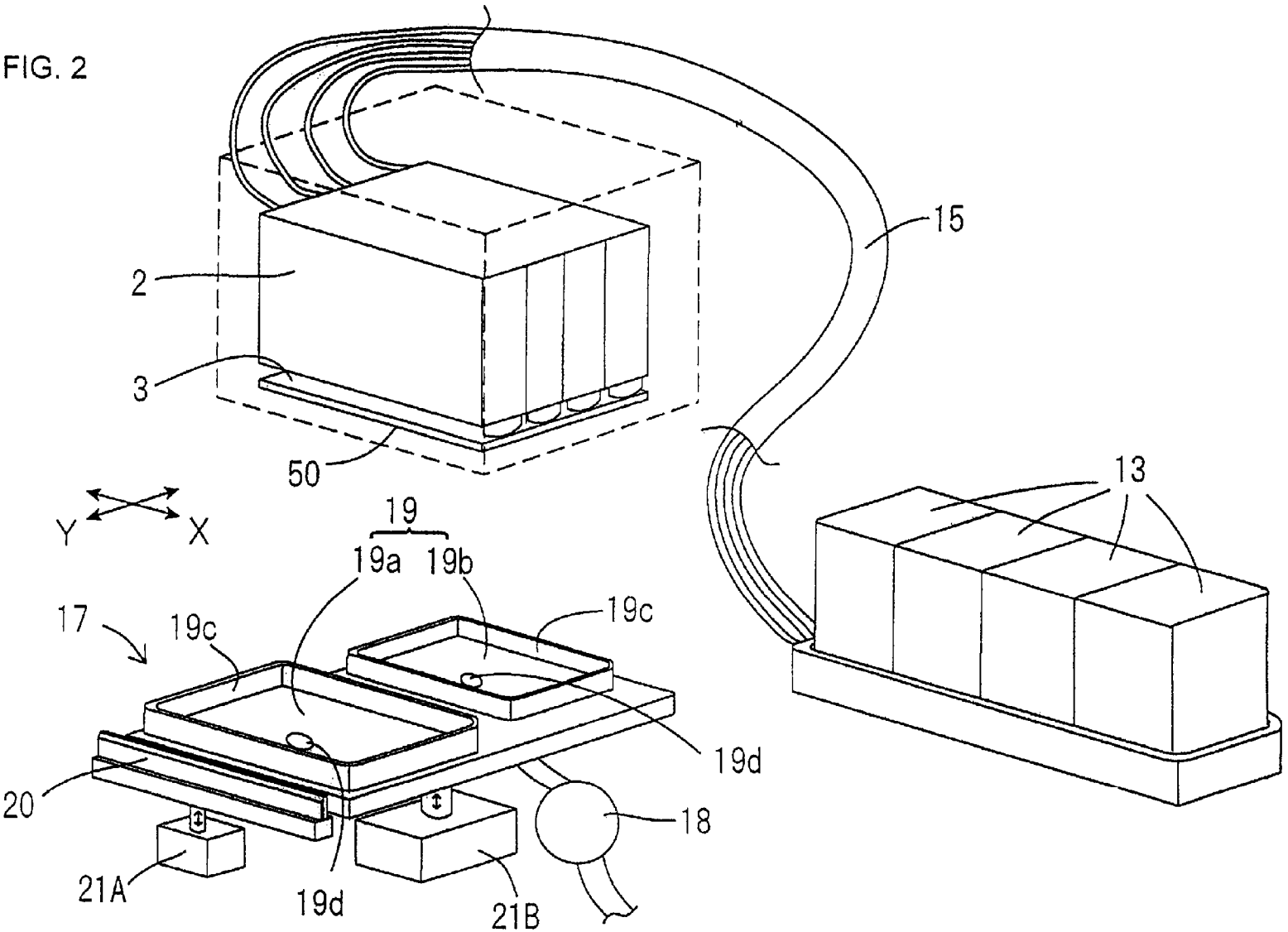
FIG. 2 is an explanatory view of a maintenance unit according to an embodiment of the invention.

Referring to FIG. 2, the maintenance unit 17 may comprise the sweeping member 20 for sweeping the nozzle face 50, and also may comprise a drawing mechanism. The sweeping member 20 and the drawing mechanism may be positioned in sequential order starting from the recording region side. The drawing mechanism may comprise a cap member 19 and a suction pump 18 connected to the cap member 19. Suction pump 18 may draw ink from the nozzles 7 via the cap member 19, and may discharge the ink into a waste liquid tank (not shown). The cap member 19 and the sweeping member 20 may be disposed such to move between a contact position with the nozzle face 50 and a separated position, e.g., a position at which the nozzle face 50 is separated from the cap member 19 and the sweeping member 20, along a direction (vertical direction) perpendicular to the scanning direction of the carriage 2, e.g., the Y-axis direction. Elevating means 21B and 21A may be configured to move the cap member 19 and the sweeping member 20, respectively.

The cap member 19 may comprise a first cap body, e.g., large cap body 19*a* and a second cap body, e.g., small cap body 19*b*, which may have different shapes when viewed in a plan view and juxtaposed along the Y-axis direction. Each of the large and small cap bodies 19*a* and 19*b* may comprise an elastic material, e.g., a rubber or a synthetic resin, and each of the large and small cap bodies 19*a* and 19*b* may have a drain hole 19*d* formed therethrough, which may be in fluid communication with the suction pump 18. Ribs 19*c* may be disposed on the peripheries of the large and small cap bodies 19*a* and 19*b*. Ribs 19*c* may protrude toward the nozzle face 50, and when being elevated by the elevating means 21B, the rib 19*c* may contact and the opposing plane due to elastic deformation. The rib 19*c* of the large cap body 19*a* may have a size such that the rib 19*c* of the large cap body 19*a* may surround the protection plate 51, and may cover the protection plate 51, to stick the nozzle face 50. The rib 19*c* of the small cap body 19*b* may have a size such that the rib 19*c* of the small cap body 19*b* may surround the second opening 53, and may contact the outer periphery of the protection plate 51 at the second widthwise plane 51*b*. The suction pump 18 selectively may be in fluid communication with the large cap body 19*a* and the small cap body 19*b* via a change over valve (not shown).

Referring to FIG. 2, the sweeping member 20 may have a substantially blade shape, and may have substantially the same length as the length of the nozzle face 50 in the X-axis direction. Sweeping member 20 may comprise a flexible material, e.g., a rubber or a synthetic resin. When coming into contact with the nozzle face 50, along with the scanning of the recording head 3, the sweeping member 20 elastically may deform according to the protection plate 51 and the second opening 53, such that sweeping member 20 may wipe the nozzle face 50, including the vicinity of the nozzle 7, and the protection plate 51.

A control unit (not shown) may control the scanning of the carriage 2 and the operation of the maintenance unit 17 as described herein. When carriage 2 moves the recording head 3 to a position opposing the large cap body 19*a*, the elevating means 21B may drive large cap body 19*a*, which may be elevated and may be brought into contact with the nozzle face 50, at a position such that the entire protection plate 51 is internally included within the large cap body 19*a*. When the recording head 3 is moved to a position opposing the small cap body 19*b*, elevating means 21B may drive the small cap body 19*b*, which may be elevated and may be brought into contact with the protection plate 51, to cover the second opening 53. In this configuration, first opening 56 may remain open to the atmosphere, e.g., in fluid communication with an exterior of the recording head.

After large cap body 19*a* or small cap body 19*b* is elevated, the suction pump 18 may be in fluid communication with one of the large cap body 19*a* and the small cap body 19*b* via the change over valve (not shown) in accordance with the respective states for the drawing operation. Elevating means 21A may elevate the sweeping member 20, and the carriage 2 may move in a state that the recording head 3 is in contact with the sweeping member 20, such that the nozzle face 50 and the protection plate 51 are wiped.

These operations may be executed periodically during recording, in the replacement of the cartridge, or at the instruction of a user pushing a button at desired timing, e.g., non-periodically. When recording head 3 is in idle for a time greater than a predetermined period, and when the power supply is turned off, large cap body 19*a* may cover the nozzle face 50, and the change over valve may be closed, such that the ink within the nozzle may be prevented from drying.

The operation of the maintenance unit 17 according to an embodiment of the invention is described herein with reference to FIGS. 7A and 8. First, the recording head 3 may be moved to a position opposing the large cap body 19*a*. Then, the large cap body 19*a* may be elevated and brought into contact with the nozzle face 50 to internally include the entire protection plate 51. As a result, both the second opening 53 and the first opening 56 may be covered with the large cap body 19*a*. In this state, e.g., a first mode, the drawing operation may be performed with the suction pump 18.

In this first mode, the same negative pressure may be applied to both the second opening 53 and the first opening 56. Thus, the same negative pressure is applied on both sides of the groove portion 54. In this first mode, ink, e.g., viscous ink, bubbles, and the like, may be drawn from the nozzle 7 and discharged. After the discharge, the suction pump 18 may be stopped, and the inside of the large cap body 19*a* may be opened to the atmosphere. Then, the large cap body 19*a* may be lowered to a position separated from the nozzle face 50.

During the drawing operation, the large cap body 19*a* may be filled with ink, such that when the large cap body 19*a* is separated from the nozzle face 50, ink may be stuck on the nozzle face 50 or on protection plate 51 at the second widthwise plane 51*b*. Thus, ink may remain within the second opening 53. This ink may be removed by a sweeping operation described herein.

In a sweeping operation, sweeping member 20 may be elevated, and the recording head 3 may be brought into contact with the sweeping member 20, and the carriage 2 may be moved while sweeping member 20 contacts the recording head 3. At this time, the sweeping member 20 may sweep the nozzle face 50 and the protection plate 51 at the second widthwise plane 51*b*, while also sweeping the vicinity of the nozzle 7 on the nozzle face 50 by entering the second opening 53 with the end portion of sweeping member 20. Thus, the drawing operation may remove ink stacked on the surface of nozzle face 50 and the protection plate 51. Nevertheless, after the sweeping operation, a portion of the ink may remain in a corner portion of the inner plane of the second opening 53, which may be defined by the nozzle face 50. This ink may remain due to the capillary action. The presence of the hood portion 55 and the groove portion 54 may result in a greater quantity of ink to be held.

Figure 9:
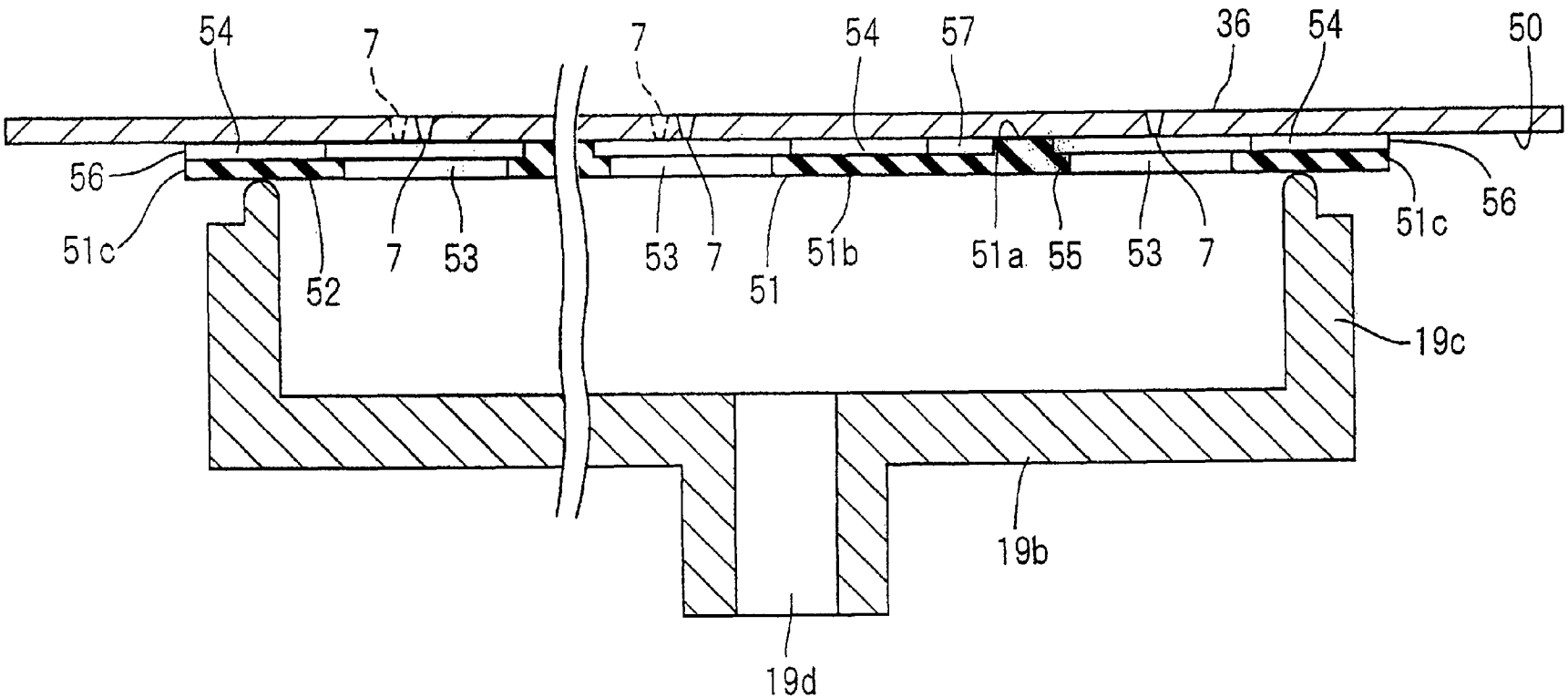
FIG. 9 is a sectional view of the recording head and the small cap body shown in FIG. 7B.

As shown in FIGS. 7B and 9, to remove the residual ink, the recording head 3 may be moved to a position opposing the small cap body 19*b*. Then, the small cap body 19*b* may be elevated and brought into contact with the protection plate 51 at the second widthwise plane 51*b*. In this state, while the second opening 53 is located inside the small cap body 19*b*, the first opening 56 may not be covered with the small cap body 19*b* but may be opened to the atmosphere, e.g., may be in fluid communication with an exterior of recording head 3. In a second mode, when the inside of the small cap body 19*b* is negatively pressurized by driving the suction pump 18, the first opening 56 may be opened to the atmosphere. Thus, in the second mode, the atmospheric air may be drawn to the second opening 53 through the groove portion 54, without drawing ink from the nozzle 7. In the second mode, ink remaining inside the groove portion 54 and the second opening 53 may be drawn and discharged. After the discharge, the small cap body 19*b* may be lowered to a position separated from the nozzle face 50.

In a recording apparatus 1 according to an embodiment of the invention, even if a recording sheet is transferred in a curved state or deformation or waviness is produced therein for abutting the recording head 3, the recording sheet may abut the protection plate 51, and may avoid directly abutting the nozzle face 50 in the vicinity of the nozzle 7. Thus, the possibility of damaging the nozzles 7 and the nozzle face 50 may be reduced, and an ink meniscus may not be abnormally formed.

As above, after the sweeping with the sweeping member 20, a portion of the ink may remain in a corner portion of the inner plane of the second opening 53 due to the capillary action. As mentioned above, the ink remaining in the second opening 53 may be removed using the small cap body 19*b*. Therefore, the remaining ink may be prevented from dropping on a recording sheet thereafter.

When the second opening 53 is deeper, e.g., the protection plate 51 is thicker, the amount of ink remaining after a sweeping operation is completed may increase. Nevertheless, the ink may be discharged by forming the second opening 53 more narrowly. By forming the second opening 53 more narrowly, e.g., increasing the relative depth of the second opening 53, the accession of the recording sheet toward the nozzle 7 may be reduced, which may reduce a chance of nozzle damage.

Figure 10:
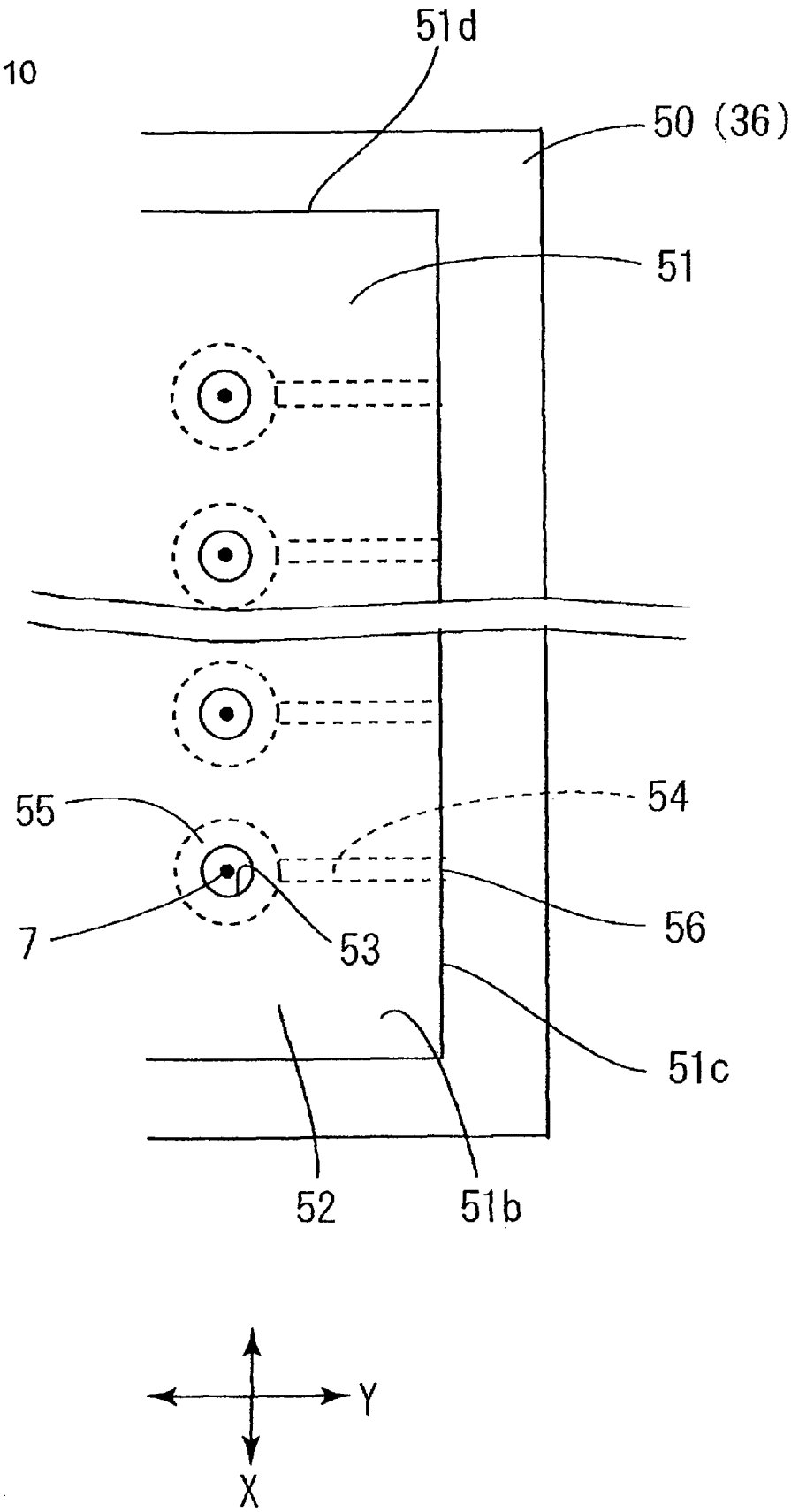
FIG. 10 is an enlarged view of an essential portion of the bottom surface of a recording head according to another embodiment of the invention.

In another embodiment of the invention, as shown in FIG. 10, upon assembling the cavity unit 30, when the metallic protection plate 51 is fixed on the resin nozzle plate 36 in advance, the rigidity of the nozzle plate 36 may be increased, such that the above-described advantages also be obtained while improving its handling when laser-beam machining the nozzle 7 on the nozzle plate, 36 or when depositing the nozzle plate 36 on the other plates to fix the nozzle plate 36 thereon.

According to an embodiment of the invention, the second opening 53 may have a continuous elongated shape extending along the extending direction of the nozzle line. In another embodiment, as shown in FIG. 9, the second opening 53 may be formed independently for each nozzle 7. In yet another embodiment, a second opening 53 may be formed for every several nozzles in one nozzle line.

According to an embodiment of the invention, the inside of both the large and small cap bodies 19*a* and 19*b* may be divided into portions corresponding to the second openings 53, or the cap body may be independently formed for each of the second openings 53. In the embodiment shown in FIG. 9, the inside of the cap body may be portioned according to the nozzle lines. In another embodiment, the cap may be formed independently.

Figure 11:
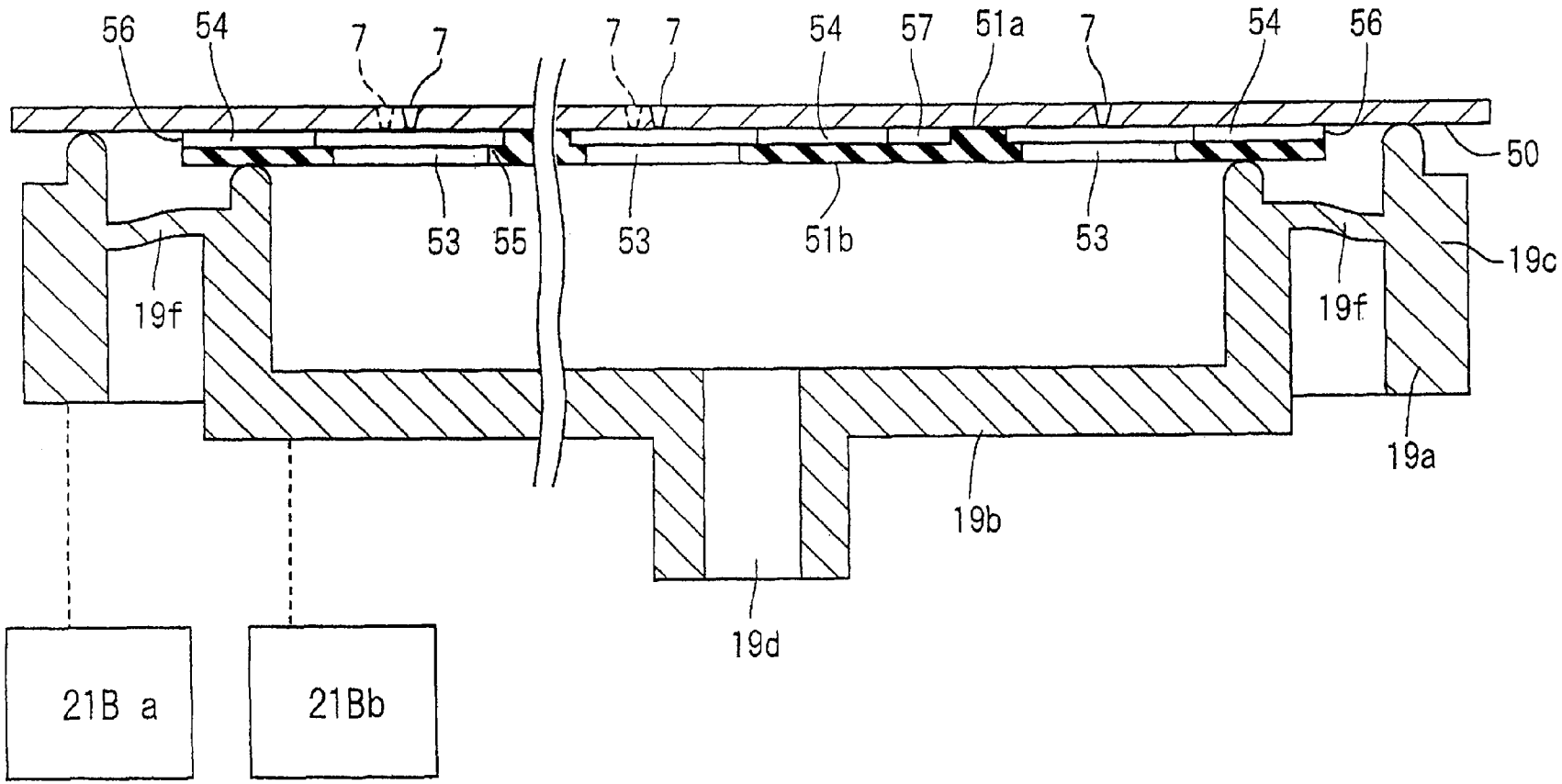
FIG. 11 is a sectional view of a recording head and a cap body according to still another embodiment of the invention.

According to an embodiment, e.g., the embodiment shown in FIG. 2, the large and small cap bodies 19*a* and 19*b* may be positioned next to each other. Alternatively, the small cap body 19*b* may be disposed inside the large cap body 19*a*, such that both cap bodies may be movable up and down relative to each other. As shown in FIG. 11, the rib 19*c* of the large cap body 19*a* may be disposed to surround the small cap body 19*b* when viewed in plan, and the ribs 19*c* of both the cap bodies may be fluid-tightly connected together with a flexible portion 19*f*. Both the cap bodies may be arranged to be movable up and down with respective elevating means 21Ba and 21Bb, and the drain hole 19*d* of the small cap body 19*b* may be connected to the suction pump 18.

In the embodiment shown in FIG. 11, when ink is drawn from the nozzle 7, the large cap body 19*a* may be brought into contact with the nozzle face 50 and the small cap body 19*b* also may be brought into contact with the protection plate 51, such that the inside of the small cap body 19*b* may be negatively pressurized by the suction pump 18. At this time, since the first opening 56 of the groove portion 54 may be enclosed with the rib 19*c* of the large cap body 19*a*, ink may be drawn from the nozzles 7. In this case, the small cap body 19*b* may be separated from the protection plate 51. Then, the large cap body 19*a* may be separated from the nozzle face 50, and only the small cap body 19*b* may be brought into contact with the protection plate 51, to removing the ink remaining in the groove portion 54 and the second opening 53. The atmospheric air is drawn through the groove portion 54 such that ink remaining in the groove portion 54 and the second opening 53 may be removed.

According to an embodiment, the nozzle face 50 and the protection plate 51 also may be wiped with the sweeping member 20 between the two drawing operations. In other embodiments, sweeping operations may not be specifically described, but may be performed as described above.

In the embodiment shown in FIG. 11, the large cap body 19*a* may have the drain hole 19*d* formed therethrough on the bottom wall in the same way as in the above-described embodiments. The small cap body 19*b* also uses the bottom wall of the large cap body 19*a* as its bottom wall. Then, when the large cap body 19*a* is brought into contact with the nozzle face 50, the small cap body 19*b* may separate from the protection plate 51, and the ink inside of the large cap body 19*a* may be drawn through the drain hole 19*d*. By such a configuration, the space for both the cap bodies can be reduced.

Figure 12:
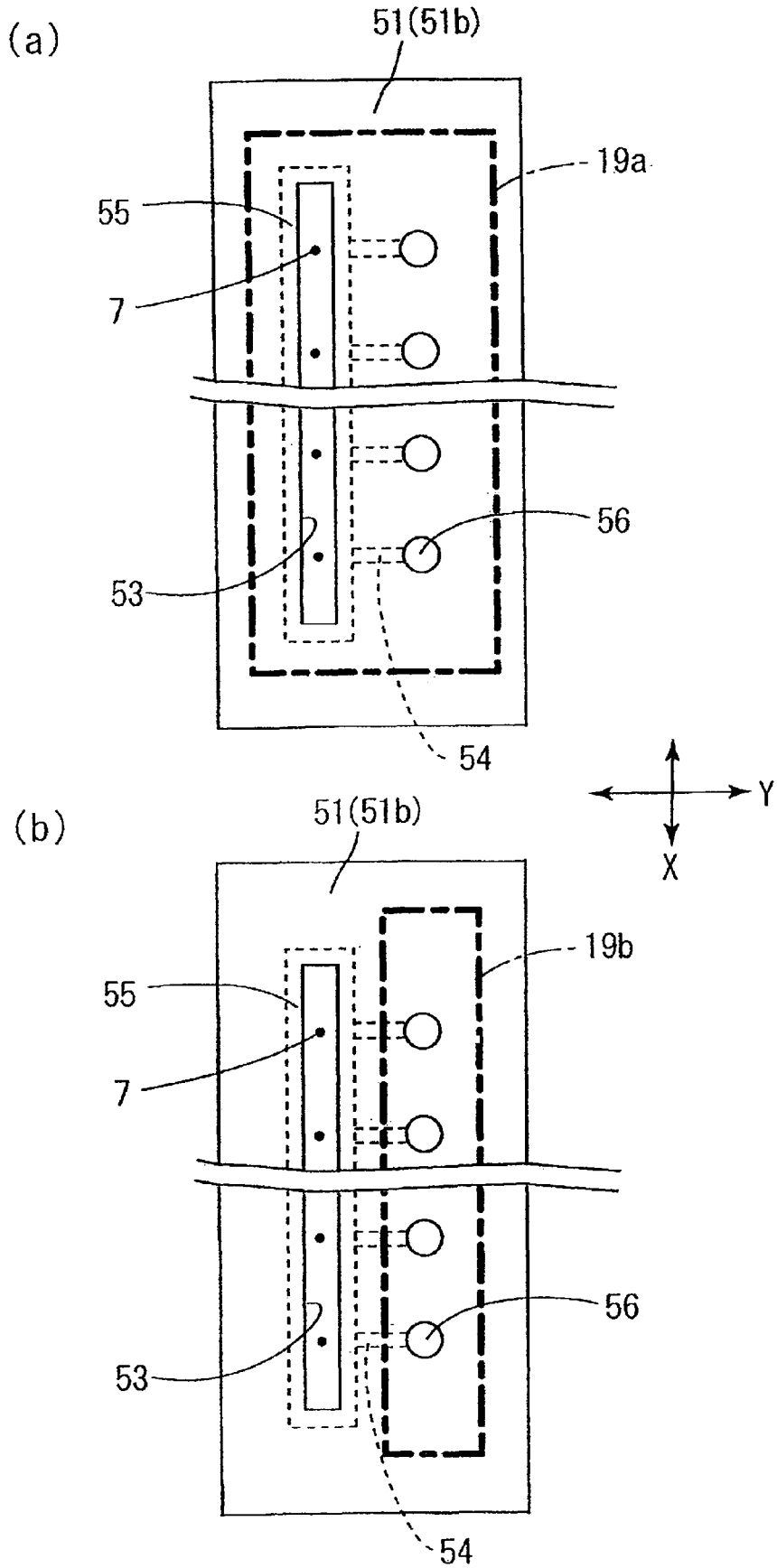
FIG. 12A is a bottom view of a recording head according to still another embodiment, illustrating the relationship between the recording head and a large cap body.
FIG. 12B is a bottom view of a recording head according to the embodiment shown in FIG. 12A, illustrating the relationship between the recording head and a small cap body.

FIG. 12 shows another embodiment of the invention. This embodiment may describe one line of the nozzles 7. Nevertheless, in other embodiments, a plurality of lines of the nozzles 7 or a plurality of the second openings 53 also may be incorporated. In these other embodiments, the protection plate 51 may be provided with a number of the second openings 53, including the hood portions 55, that corresponds to the number of lines of the nozzles 7 formed in the same way as in the embodiments described above. According to this embodiment, the first opening 56 at the end of the groove portion 54 may be configured to open to the atmosphere at the second widthwise plane 51*b*. In the other words, the first opening 56 is formed not on the side of the protection plate 51, but on the plane opposing a recording sheet, e.g., the second widthwise plane 51*b*. The first opening 56 may not necessarily be independently formed for each groove portion 54. Thus, one first opening 56 may also be formed for a plurality of the groove portions 54.

The shape of the protection plate 51 in plan view may be identical to that of the nozzle face 50 in this embodiment, because the first opening 56 may not open on the side of the protection plate 51. Similarly to the previously-described embodiments, the shape of the protection plate 51 in plan view may be reduced such that the protection plate 51 may have a size smaller than that of the nozzle face 50.

The maintenance unit 17 may comprise the large cap body 19*a* shown in FIG. 12A and the small cap body 19*b* shown in FIG. 12B, as the cap member 19. The rib 19*c* of the large cap body 19*a* may have a planar shape that simultaneously surrounds the second opening 53 and the first opening 56 by closely sticking to the protection plate 51, while the rib 19*c* of the small cap body 19*b* may have a planar shape that surrounds the first opening 56 by closely sticking to the protection plate 51. In this embodiment, when ink is drawn from the nozzles 7, the large cap body 19*a* may be brought into contact with the protection plate 51 by simultaneously covering the second opening 53 and the first opening 56 therewith, as shown in FIG. 12A. In this position, by driving the suction pump 18, the second opening 53 and the first opening 56 may be substantially simultaneously negatively pressurized. Thus, ink, e.g., failed ink, bubbles, and the like may be removed from the nozzles 7.

For removing the ink remaining in the groove portion 54 and the second opening 53, the small cap body 19*b* may be brought into contact with the protection plate 51, such that first opening 56 may be covered, and that second opening 53 may be open to the atmosphere, e.g., in fluid communication with an exterior of the protection plate 51, as shown in FIG. 12B. In this position, the ink remaining inside the second opening 53 and in the groove portion 54 may be removed by drawing the ink through the first opening 56.

When the small cap body 19*b* is brought into contact with the protection plate 51 by covering the second opening 53 and by opening the first opening 56 to the atmospheric air, e.g., by fluidly communicating the first opening 56 to an exterior of the recording head 3, ink inside the second opening 53 and in the groove portion 54 also may be drawn and removed in the same way. According to an embodiment, the large cap body 19*a* and the small cap body 19*b* may be juxtaposed as shown in FIG. 2, and in another embodiment, the small cap body 19*b* also may be arranged inside the large cap body 19*a*, as shown in FIG. 11. Moreover, in another embodiment of the invention, a raised portion may be disposed at a position opposing the first opening 56 of the large cap body 19*a*, and when the large cap body 19*a* is brought into contact with the protection plate 51, the first opening 56 may also be blocked up with the raised portion.

Figure 13:
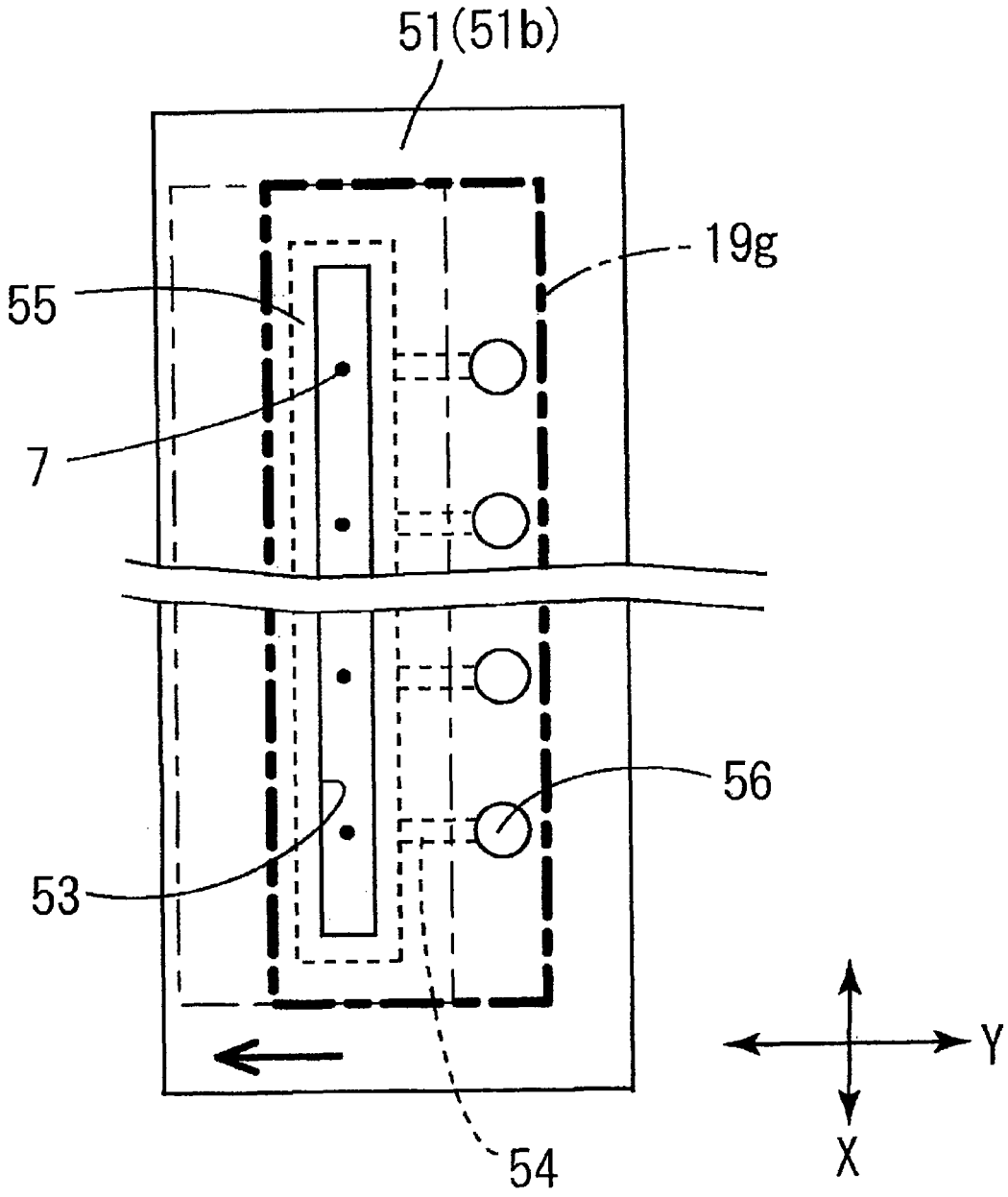
FIG. 13 is a bottom view of a recording head according to still another embodiment.

FIG. 13 shows still another embodiment of the invention. In this still another embodiment, the two drawing operations may be performed with one cap body 19*g*, by eliminating the small cap body 19*b*. The cap body 19*g* may have a size that may simultaneously cover the second opening 53 and the first opening 56, and the protection plate 51 also has a size that the cap body 19*g* may be brought into contact with the protection plate 51 even if the cap body 19*g* is displaced in the Y-axis direction to cover only the second opening 53, or to cover only the first opening 56, without protruding from the protection plate 51. The cap body 19*g* may comprise the rib 19*c*, and the drain hole 19*d* may be connected to the suction pump 18 in the same way as in the embodiments described above.

In the embodiment shown in FIG. 13, first, the second opening 53 and the first opening 56 simultaneously may be covered with the cap body 19*g*, and ink may be drawn from the nozzles 7. Then, the cap body 19*g* may be separated from the protection plate 51, and the wiping operation may be executed with the sweeping member 20. Then, by moving the recording head 3 in the Y-axis direction, e.g., by displacing in parallel, only one of the second opening 53 and the first opening 56 is covered with the cap body 19*g*, and the other of the second opening 53 and the first opening 56 may be opened to the outside, e.g., in fluid communication with an exterior of the recording head 3. The ink remaining inside the second opening 53 and in the groove portion 54 may be drawn and removed, using a simplified structure of the cap member 19.

If the protection plate 51 is smaller in size than the nozzle face 50 and the cap body 19*g* contacts across the nozzle face 50 and the protection plate 51 when the cap body 19*g* deforms in accordance with a difference in level between the nozzle face 50 and the protection plate 51, as mentioned above, the embodiment shown in FIG. 13 also may be incorporated in a case where the first opening 56 is opened, e., is in fluid communication with an exterior of the recording head 3, to the side 51*c* of the protection plate 51.

Figure 14:
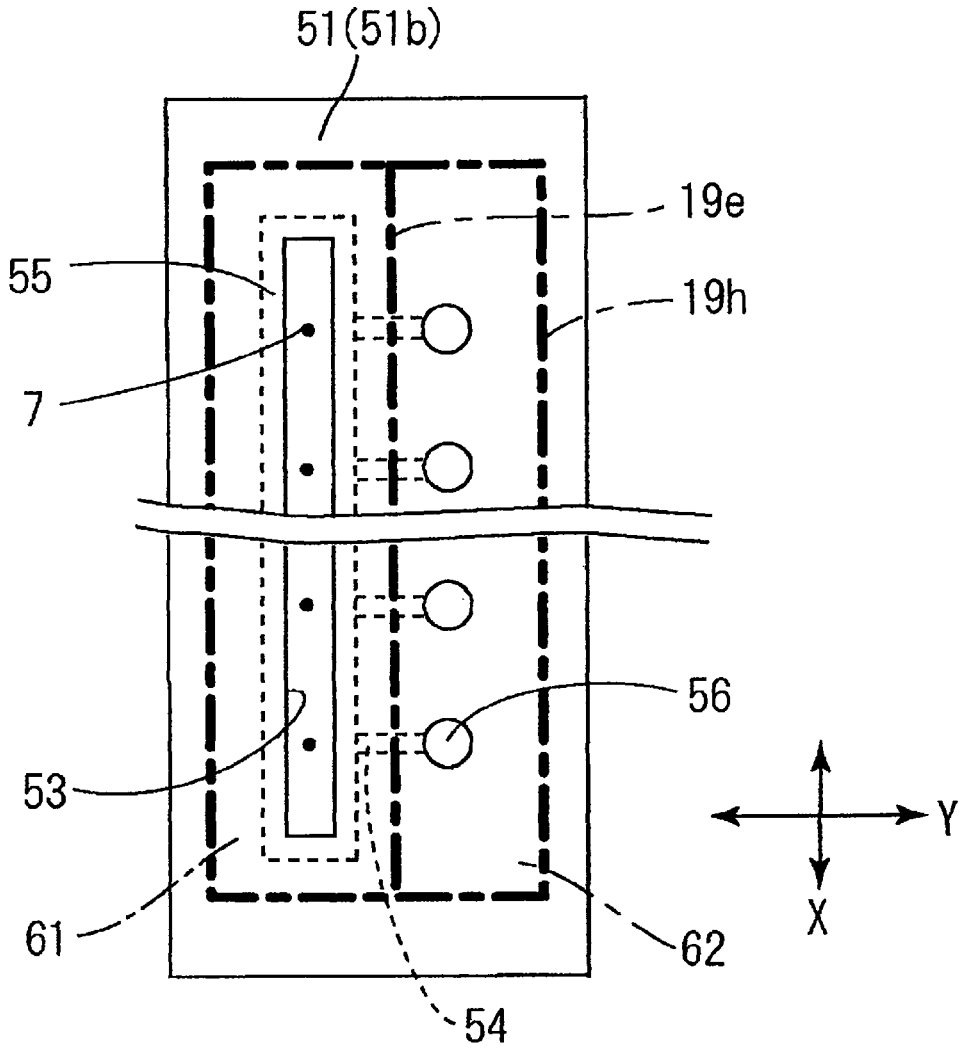
FIG. 14 is a bottom view of a recording head according to still another embodiment.

FIG. 14 shows still another embodiment of the invention. A cap body 19*h* may be the same size as that of the large cap body 19*a*, and cap body 19*h* may be divided into two regions 61 and 62 across a rib 19*e*. The regions 61 and 62 may be connected to the suction pump 18 via the change over valve, similarly to the embodiments mentioned above. One divided region 61 may be disposed to cover the second opening 53 while the other divided region 62 may be disposed to cover the first opening 56.

In this configuration, when ink is drawn from the nozzles 7, the cap body 19*h* may contact the protection plate 51, and both the regions 61 and 62 may be simultaneously drawn. By setting the change over valve to enclose the region 62 covering the first opening 56, only the region 61 covering the second opening 53 may be drawn. When removing ink remained inside the second opening 53 and in the groove portion 54, the change over valve is set such that one of region 61 and region 62 may be connected to the atmospheric air, while the other of region 61 and region 62 may be connected to the suction pump 18. When the suction pump 18 is driven in this state, ink remaining inside the second opening 53 and in the groove portion 54 may be drawn and removed. The embodiment shown in FIG. 14 also may be incorporated in a case where a plurality of the nozzle lines or the through portions are provided, e., as shown in FIG. 5.

The liquid droplet ejecting apparatus described above is not limited to the recording apparatus having an inkjet recording head. In another embodiment, an apparatus for forming a circuit pattern by ejecting conductive liquid on a flexible insulating substrate or an apparatus for ejecting a dyeing solution on a cloth also may be incorporated therein.

In the embodiments described above, the groove portion 54 may be formed on the protection plate 51. Nevertheless, in another embodiment, the groove portion also may be formed by an opening in the nozzle face 50. In still another embodiment, groove portions may be formed on one or both of the nozzle face 50 and the protection plate 51.

In still another embodiment, the groove portion may not have a groove-like shape, but rather may be a flow path formed as a hollow portion within a plate, e.g., one or more of the protection plate 51 and the nozzle plate 36.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A liquid-droplet ejecting apparatus comprising:

a drawing mechanism configured to draw liquid from a plurality of nozzles; and an ejection head, the ejection head comprising:

a nozzle face comprising the plurality of nozzles, wherein the plurality of nozzles are configured to eject liquid; and a protection plate configured to protect the plurality of nozzles, the protection plate comprising:

a frame portion surrounding the plurality of nozzles;

a first end fixed to the nozzle face and positioned at a first widthwise plane; and a second end opposite the first end, wherein the protection plate has a first opening and at least one second opening formed therethrough, wherein the first opening is configured to provide fluid communication between at least one of the plurality of nozzles and an exterior of the ejection head, and wherein the at least one second opening is configured to provide fluid communication between the plurality of nozzles and an exterior of the protection plate at a second widthwise plane, wherein at least a portion of the protection plate and at least a portion of the nozzle face define at least one flow path therebetween, and the at least one flow path is configured to provide fluid communication between the first opening and the at least one second opening, and wherein the drawing mechanism comprises:

a cap member configured to selectively contact and separate from at least one of the nozzle face of the ejection head and the protection plate, wherein when the cap member contacts the at least one of the nozzle face and the ejection head, a space is formed between the cap member and the at least one of the nozzle face and the ejection head; and a pressure reducing member configured to reduce the pressure in the space, wherein the drawing mechanism is configured to selectively operate in one of a first mode in which the cap member covers the first opening and the at least one second opening, and the drawing mechanism draws ink from the first opening and from the at least one second opening, and a second mode in which the cap member seals one of the first opening and the at least one second opening, and the drawing mechanism draws ink from the sealed one of the first opening and the at least one second opening.

2. The apparatus according to claim 1, wherein the cap member comprises a first cap body and a second cap body, wherein the first cap body is configured to cover a first region of the at least one of the nozzle face of the ejection head and the protection plate, and the second cap body is configured to cover a second region of the at least one of the nozzle face of the ejection head and the protection plate, wherein the first region is a different size than the second region, and wherein when the drawing mechanism operates in the first mode, the first cap body covers the first opening and the at least one second opening, and when the drawing mechanism operates in the second mode, the second cap body seals one of the first opening and the at least one second opening.

3. The apparatus according to claim 2, wherein the second cap body is disposed within the first cap body.

4. The apparatus according to claim 3, wherein the first cap body and the second cap body are integrally formed with a flexible portion formed therebetween.

5. The apparatus according to claim 1, wherein when the drawing mechanism is in a first mode, the cap member contacts the at least one of the nozzle face of the ejection head and the protection plate at a first position, and when the drawing mechanism is in the second mode, the cap member contacts the at least one of the nozzle face of the ejection head and the protection plate at a second position, and wherein the first position is disposed a particular distance away from the second position in a direction parallel to a direction of a movement of the cap member.

6. The apparatus according to claim 1, wherein a surface of the protection plate is smaller in area than a surface of the nozzle face that contacts the protection plate at the first widthwise plane, and the first opening opens through to a side of the protection plate, wherein the side of the protection plate intersects the first widthwise plane and the second widthwise plane, and wherein when the drawing mechanism is in the first mode, the cap member is configured to contact the nozzle face and to surround the protection plate.

7. The apparatus according to claim 1, wherein the first opening is configured to be in fluid communication with an exterior of the ejection head at the second widthwise plane.

8. The apparatus according to claim 1, wherein a hood portion is positioned within a portion of the at least one second opening at an end of the at least one second opening adjacent to the second widthwise plane, and wherein the hood portion extends such that the portion of the at least one second opening is reduced in diameter.

9. The apparatus according to claim 1, wherein the plurality of nozzles are arranged in one or more nozzle lines, and the at least one second opening comprises a plurality of second openings formed in the protection plate therethrough, at positions opposing the one or more nozzle lines continuously along an extending direction of the one or more nozzle lines.

10. The apparatus according to claim 9, wherein the at least one flow path comprises a plurality of flow paths, and each of the plurality of flow paths provides fluid communication between one of the plurality of second openings and the first opening, and each of the plurality of flow paths is disposed at a pitch equal to or smaller than a pitch of the plurality of the nozzles along the one or more nozzle lines.

11. The apparatus according to claim 9, wherein the at least one flow path comprises a plurality of flow paths, and each of the plurality of flow paths is connected to one of the at least one second openings, and each of the plurality of the flow paths is configured to be in fluid communication with the first opening via a common flow path that is configured to be common to the plurality of the flow paths.

12. The apparatus according to claim 1, wherein the plurality of nozzles are arranged in one or more lines, and one of the at least one second openings is formed for each of the plurality of nozzles.

13. The apparatus according to claim 12, wherein the at least one flow path comprises a plurality of flow paths, and each of the plurality of flow paths is connected to one of the at least one second openings corresponding to each of the plurality of nozzles arranged in one or more lines, and wherein each of the plurality of flow paths is disposed at a pitch equal to or smaller than a pitch of the plurality of the nozzles along the one or more nozzle lines.

14. The apparatus according to claim 1, wherein a surface of the protection plate disposed at the second widthwise plane is configured to be processed to increase a contacting force between the liquid and the surface of the protection plate, relative to an exposed portion of the nozzle face.

15. The apparatus according to claim 1, wherein the plurality of nozzles are formed on a thin nozzle plate comprising a resin, and wherein the protection plate comprises a metal.

16. The apparatus according to claim 1, wherein the at least one flow path comprises a groove portion concavely formed at the first widthwise plane, the groove portion comprising a first end and a second end, wherein the first end of the groove portion is in fluid communication with the at least one second opening, and the groove portion extends along the first widthwise plane in a direction away from the at least one second opening.

17. The apparatus according to claim 1, wherein a surface of the protection plate is smaller in area than a surface of the nozzle face that contacts the protection plate at the first widthwise plane, and the first opening opens through to a side of the protection plate, wherein the side of the protection plate intersects the first widthwise plane and the second widthwise plane, and wherein when the drawing mechanism is in the second mode, the cap member is configured to contact the frame portion of the protection plate at the second widthwise plane, and to be separated from the nozzle face.

18. The apparatus according to claim 1, wherein when the drawing mechanism is in the second mode, an unsealed one of the first opening and the at least one second opening is in fluid communication with an exterior of the ejection head.

* * * * *